US011731803B2

(12) United States Patent
Green

(10) Patent No.: US 11,731,803 B2
(45) Date of Patent: Aug. 22, 2023

(54) COLLAPSIBLE CRATE WITH STOWABLE HINGED LID

(71) Applicant: Jeff Green, Beverly Hills, CA (US)

(72) Inventor: Jeff Green, Beverly Hills, CA (US)

(73) Assignee: The Merchant of Tennis, Inc., Beverly Hills, CA (US)

( * ) Notice: Subject to any disclaimer, the term of this patent is extended or adjusted under 35 U.S.C. 154(b) by 0 days.

(21) Appl. No.: 17/367,148

(22) Filed: Jul. 2, 2021

(65) Prior Publication Data

US 2023/0002112 A1 Jan. 5, 2023

(51) Int. Cl.
*B65D 43/16* (2006.01)
*B65D 6/18* (2006.01)

(52) U.S. Cl.
CPC ..... *B65D 11/1826* (2013.01); *B65D 43/161* (2013.01); *B65D 2543/00231* (2013.01)

(58) Field of Classification Search
CPC . B65D 11/1826; B65D 11/18; B65D 11/1833; B65D 11/1893; B65D 43/161; B65D 2543/00231
See application file for complete search history.

(56) References Cited

U.S. PATENT DOCUMENTS 770,595 A * 9/1904 Lovette ..... E05D 1/06 16/260
2,972,430 A 2/1961 Johnson
3,424,365 A 1/1969 Venturi
3,556,339 A 1/1971 Lind et al.
3,675,808 A 7/1972 Brink
3,796,342 A 3/1974 Sanders et al.
3,896,962 A * 7/1975 Smith ..... B42F 15/0094 220/543
4,044,910 A 8/1977 Box
4,508,237 A 4/1985 Kreeger et al.
4,684,034 A 8/1987 Ono et al.
4,693,387 A 9/1987 Stonier
(Continued)

FOREIGN PATENT DOCUMENTS

EP 1609725 12/2005
GB 2362635 11/2001

OTHER PUBLICATIONS

Canadian Office action dated Mar. 9, 2017, for Canadian Patent Application No. 2,918,113, 3 pages.
(Continued)

*Primary Examiner* — Don M Anderson
(74) *Attorney, Agent, or Firm* — Lewis Roca Rothgerber Christie LLP

(57) ABSTRACT

A collapsible crate or container movable between an erect configuration and a collapsed configuration, has a crate member having an upper peripheral rim, a bottom member, two hinged and collapsible opposing side walls and two hinged end walls that collectively define an interior volume when the crate member is in the erect configuration, and a lid member with first and second lid portions and a hinge that releasably couples the first and second lid portions. The crate member and the lid member also includes latch member to releasably latch the lid member to the crate member in a use/deployed position and a stowed position.

21 Claims, 16 Drawing Sheets

(56) References Cited

U.S. PATENT DOCUMENTS 4,775,069 A * 10/1988 Stonier ..... B42F 15/0094 220/6
4,798,304 A 1/1989 Rader
D302,897 S 8/1989 Shchamorov et al.
4,913,302 A 4/1990 Stonier
4,960,223 A 10/1990 Chiang et al.
5,038,953 A * 8/1991 Radar ..... B42F 15/0094 220/6
5,190,152 A * 3/1993 Smith ..... B42F 15/0094 220/826
5,253,763 A 10/1993 Kirkley et al.
5,323,921 A 6/1994 Olsson
D355,073 S 2/1995 Junaedi
5,515,987 A 5/1996 Jacques et al.
5,538,153 A 7/1996 Marovskis et al.
5,588,549 A 12/1996 Furtner
5,671,858 A 9/1997 Hsu
5,746,342 A 5/1998 Jacques et al.
5,842,570 A 12/1998 Turnbull
6,152,318 A 11/2000 Walker
6,193,340 B1 * 2/2001 Schenker ..... A47B 47/0075 312/265.5
6,299,011 B1 10/2001 Rosenfeldt
6,405,888 B1 6/2002 Overholt et al.
6,446,825 B1 9/2002 Godoy
6,616,003 B1 9/2003 Polenta
6,868,979 B2 3/2005 Rader
6,913,161 B2 * 7/2005 Schafer ..... B65D 11/184 220/4.28
6,918,502 B1 7/2005 Overholt et al.
7,017,766 B2 3/2006 Hsu et al.
7,048,135 B2 5/2006 Smyers et al.
7,059,489 B2 6/2006 Apps et al.
7,083,061 B2 8/2006 Spindel et al.
7,104,414 B2 9/2006 Apps et al.
7,137,522 B2 * 11/2006 Dubois ..... B65D 11/1826 206/509
7,159,730 B2 1/2007 Rumpel
7,175,040 B2 2/2007 Lorenz et al.
7,195,127 B2 3/2007 Hsu et al.
7,290,663 B2 11/2007 Deng et al.
7,370,771 B2 5/2008 Rader
7,478,726 B2 1/2009 Apps et al.
7,549,550 B2 6/2009 Smyers et al.
7,556,165 B2 7/2009 McDade
7,717,283 B2 5/2010 Apps et al.
7,784,632 B2 8/2010 Truong
7,861,458 B2 1/2011 Apps et al.
7,861,878 B2 1/2011 Escarpa Gil
7,861,879 B2 1/2011 Samprathi
7,921,998 B2 4/2011 Schenker
8,205,763 B2 6/2012 Fredrickson
8,267,270 B2 9/2012 Samprathi
8,308,018 B2 11/2012 Kochanowski
8,342,347 B2 1/2013 Hay
8,348,076 B2 1/2013 Rader et al.
8,485,376 B2 7/2013 Samprathi
8,573,433 B2 11/2013 Kochanowski
8,640,912 B2 2/2014 Orgeldinger
8,757,412 B2 6/2014 Sommer et al.
8,870,008 B2 10/2014 Wu et al.
8,875,924 B2 11/2014 Orgeldinger
9,371,154 B2 6/2016 Samprathi
D801,686 S 11/2017 Park
10,065,763 B2 9/2018 Wilcox
11,027,893 B2 6/2021 French et al.
11,352,168 B2 * 6/2022 Green ..... B65D 11/1826
2002/0108951 A1 8/2002 Zelko
2003/0006232 A1 1/2003 Raghunathan et al.
2003/0116564 A1 6/2003 Overholt et al.
2004/0226945 A1 11/2004 Hsu et al.
2006/0231555 A1 10/2006 Smyers et al.
2007/0095825 A1 5/2007 Tsao
2007/0210083 A1 9/2007 Li
2007/0278223 A1 * 12/2007 Ficker ..... B65D 11/184 220/6
2008/0116201 A1 5/2008 Baltz
2009/0000975 A1 1/2009 Schenker
2009/0107998 A1 4/2009 Meissen
2009/0114645 A1 5/2009 Zemer
2009/0159593 A1 6/2009 Apps
2015/0014310 A1 1/2015 Liu et al.
2015/0028027 A1 1/2015 Cavalcante et al.
2015/0060442 A1 3/2015 Liu et al.
2015/0375558 A1 12/2015 Ben-Or
2016/0272363 A1 * 9/2016 Matsuoka ..... B65D 11/1833
2016/0368656 A1 * 12/2016 Green ..... B65D 11/1826
2017/0137175 A1 5/2017 Park
2017/0297362 A1 10/2017 Bauer et al.
2020/0377267 A1 * 12/2020 Lee ..... B65D 43/0212
2021/0016922 A1 * 1/2021 Leng ..... B65D 43/165
2022/0033151 A1 * 2/2022 Green ..... B62B 5/0093
2022/0055795 A1 * 2/2022 Yoshida ..... B29C 43/16
2022/0267055 A1 * 8/2022 Urciuoli ..... B65D 43/161
2022/0274737 A1 * 9/2022 Richardson ..... B65D 25/2873

OTHER PUBLICATIONS

Canadian Office action dated Jan. 15, 2020, for Canadian Patent Application No. 3,031,637, 4 pages.
Canadian Office action dated Jun. 22, 2020, for Canadian Patent Application No. 3,031,637, 4 pages.
SSI Schaefer, For the Best Return Schaefer Collapsible Containers, product catalog pages available at http://www.ssi-schaefer.us/fileadmin/ssi/images/us/Stor-Dist/bins-cont/CF_Collapsible_Containers.pdf 2 pages, printed Jul. 30, 2015.
ORBIS FC2415-089 product webpage available at http://www.orbiscorporation.com/Products/Hand-Held-Containers/Collapsible/FC2415-089#VbloYvlVhBc 1 page, printed Jul. 30, 2015.
Today's the Best Day Making Every Day the Best Day for Your Marriage and Your Family, Clever Crates—Review and Giveaway, dated Mar. 19, 2015, found at http://www.todaysthebestday.com/clever-crates-review-giveaway/, 4 pages.
PCT International Search Report and Written Opinion dated Sep. 16, 2022, in corresponding International Application No. PCT/US2022/034553, 14 pages.

* cited by examiner

COLLAPSIBLE CRATE WITH STOWABLE HINGED LID

BACKGROUND

1. Field

The present disclosure relates generally to the field of storage boxes, and more particularly to a collapsible storage box (or crate or container or bin, all used interchangeably herein).

2. Description of the Related Art

Crates or containers for storing objects are well known. Collapsible crates that may be adjusted between a collapsed (or substantially flat) position and an erect (or substantially upright) position provide a user with the ability to store objects when needed and to reduce the area required to store an empty crate, for example, a crate that is not in use. However, many existing collapsible rates may be heavy, costly and/or difficult to manufacture, and may employ complicated mechanisms that keep the crate in an erect position. Stability and swift assembly and disassembly are desirable features in a collapsible crate. Moreover, lids are desirable for such collapsible crates so that the interior and contents can be protected and secured, and additional collapsible crates or other objects can be stacked on top. It is also desirable that such lids be structurally reinforced to support additional weight and load from such stacked crates and objects and that such lids lie at least flush with an upper rim of the crate to promote stability of the crates or objects stacked above. It is yet also desirable that such lids be releasably latched to the crates when deployed to cover the crates and be releasably latched to a bottom of the crates for stowage. It is further desirable that such lids when deployed in covering the crates be configured to allow users to partially open the lids as a convenience for access the interior and contents without complete removal of the lids.

SUMMARY

In one or more embodiments, a collapsible crate movable between an erect configuration and a collapsed configuration, has a crate member having an upper peripheral rim, a bottom member, two hinged and collapsible opposing side walls and two hinged end walls that collectively define an interior volume when the crate member is in the erect configuration, and a lid member with first and second lid portions and a hinge between the first and second lid portions.

In one or more embodiments, the collapsible crate also includes a releasable latch configured to releasably latch the lid member to the crate member, the releasable latch having with a male member and a female member, wherein the male member is formed in one of the group consisting of the lid member and the peripheral rim and the female member formed in the other of the group consisting of the lid member and the peripheral rim.

In one or more embodiments, the lid member has a flange, and the upper peripheral rim has a groove and a rail, wherein the flange is configured to fit in the groove when the lid member is positioned to cover the crate member in the erect configuration.

In one or more embodiments, the lid member has a flange, and the bottom member has a bottom rail, wherein the bottom rail is configured to sit inside of the flange when the lid member is stowed under the bottom member.

In one or more embodiments, the collapsible crate includes a releasable latch configured to releasably latch the lid member to the bottom member, the releasable latch having with a male member and a female member, wherein the male member is formed in one of the group consisting of the lid member and the bottom rail and the female member formed in the other of the group consisting of the lid member and the bottom rail.

In one or more embodiments, the lid member has a rib member and the rail of the peripheral rim has a corresponding slot configured to receive the rib member when the lid member is positioned to cover the crate member in the erect configuration.

In one or more embodiments, the lid member has a rib member and the bottom rail has a corresponding slot configured to receive the rib member when the lid member is stowed under the bottom member.

In one or more embodiments, at least one of the first and second lid portions includes an access opening.

In one or more embodiments, the hinge of the lid member is configured such that the lid member is movable between a fully-closed position with the first and second lid portions generally defining a common plane and a partially-closed position with the first and second lid portions defining an angle between them at the hinge.

In one or more embodiments, the hinge of the lid member is configured to releasably couple the first and second lid portions.

In one or more embodiments, a collapsible crate movable between an erect configuration and a collapsed configuration, has a crate member having an upper peripheral rim, two hinged and collapsible opposing side walls, two hinged end walls and a bottom member that collectively define an interior volume when the crate member is in the erect configuration, and a lid member with first and second lid portions and a hinge between the first and second lid portions, wherein the lid member includes a first latch member and the crate member includes a second latch member configured to releasably latch with the first member.

In one or more embodiments, the first latch member includes a male member and the second latch member includes a female member.

In one or more embodiments, the male member includes a nub and the female member includes an opening.

In one or more embodiments, wherein the bottom member of the crate member includes a third latch member configured to releasably latch with the first latch member of the lid member.

In one or more embodiments, the upper peripheral rim includes a groove and the lid member includes a flange configured to sit in the groove when the lid member is positioned to cover the crate member.

In one or more embodiments, the lid member is configured to sit no higher than an upper surfaced of the rim of the crate member.

In one or more embodiments, the crate member has an upper latch member formed in the rim and a lower latch member formed in the bottom member, wherein the upper latch member is configured to releasably latch the lid member in a use position and the lower latch member is configured to releasably latch the lid member in a stowed position.

In one or more embodiments, the lid member has an access opening.

In one or more embodiments, the upper peripheral rim includes a rail, and the rail and the rim are configured to suspend a hanging file folder for use with the crate.

In one or more embodiments, the lid member has a rib member and the rim has a rail with a slot configured to receive the rib member when the lid member is positioned on the crate member.

In one or more embodiments, the lid member has a flange and a rib member extends from the flange.

In one or more embodiments, the hinge between the first and second lid portions includes a male knuckle and a female knuckle, wherein the male knuckle has a pin and the female knuckle has an aperture configured to receive the pin.

In some embodiments, the female knuckle includes a notch that leads into the aperture configured to ease entry and exit of the pin into the aperture.

In some embodiments, the male and female knuckles are sized to provide a predetermined space gap between their adjacent ends.

In some embodiments, the hinge is configured to provide bi-directional folding of the first and second lid portions along the hinge.

BRIEF DESCRIPTION OF THE DRAWINGS

These and other features and aspects of embodiments of the present disclosure will be better understood by reference to the following detailed description, when considered in conjunction with the accompanying drawings. The same numbers are used throughout the figures to reference like features and components.

DETAILED DESCRIPTION

The present disclosure is directed to a collapsible crate (or box or container, all used interchangeably herein). The figures depict some example embodiments as applied to a collapsible crate for illustrative purposes only, and it will be apparent that modifications may be made without departing from the spirit and scope of the invention, and also that the present disclosure may be used in other applications in the same or similar fields. Although relative terms such as "first," "second," "third," "fourth," "top," "bottom," "upper," lower," "right," "left," "length," "width," "depth," "standing," "erect," "vertical," "horizontal," and similar terms have been used herein to describe relative spatial relationships between elements and/or orientation, it is to be understood that these terms are intended to encompass different orientations of the various elements and components of the device in addition to the orientation depicted in the figures. Moreover, the figures contained in this application are not necessarily to scale.

Figure 1:
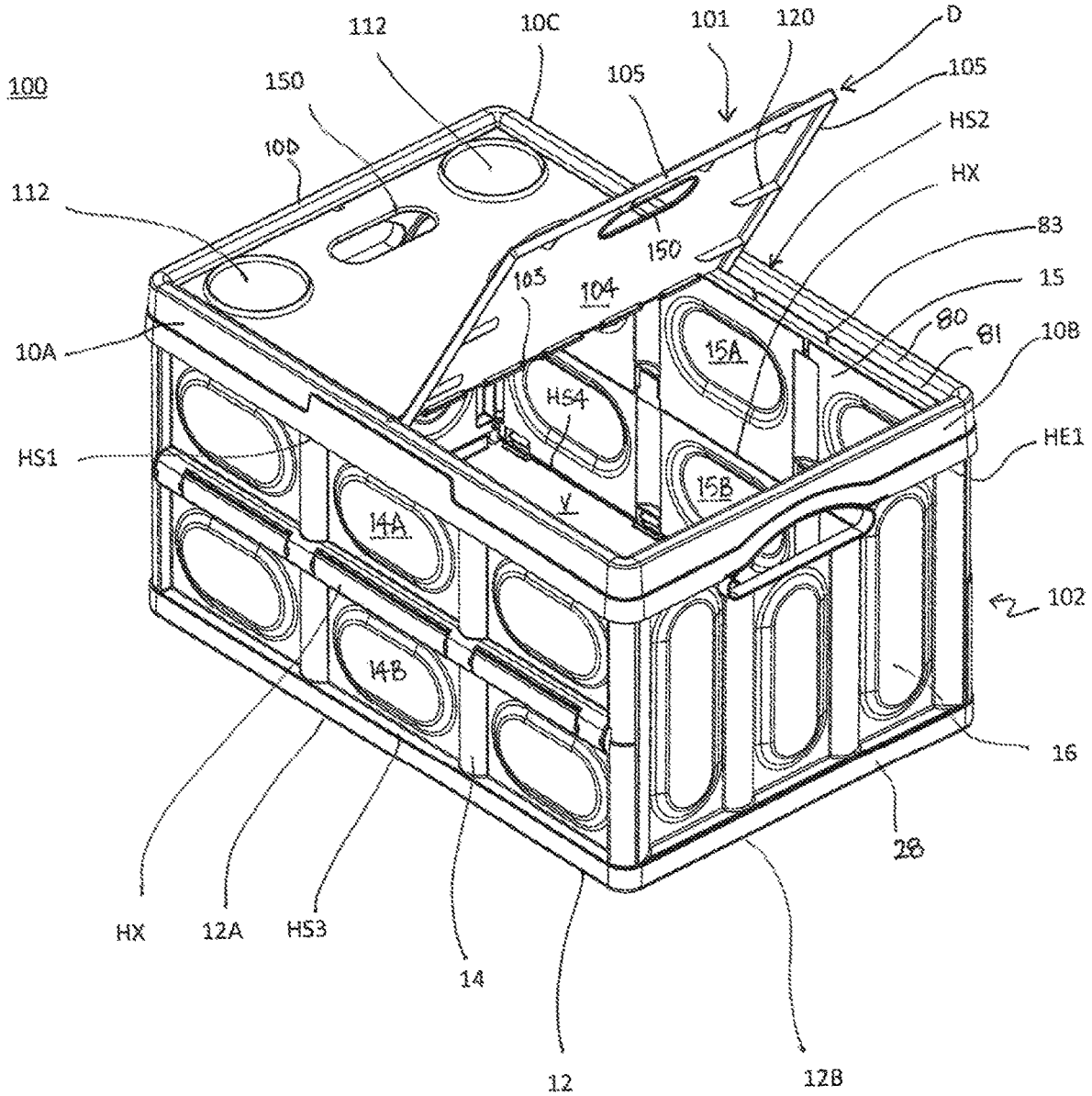
FIG. 1 is a perspective view of a collapsible crate in an erect configuration according to one or more embodiments of the present disclosure.
Figure 2:
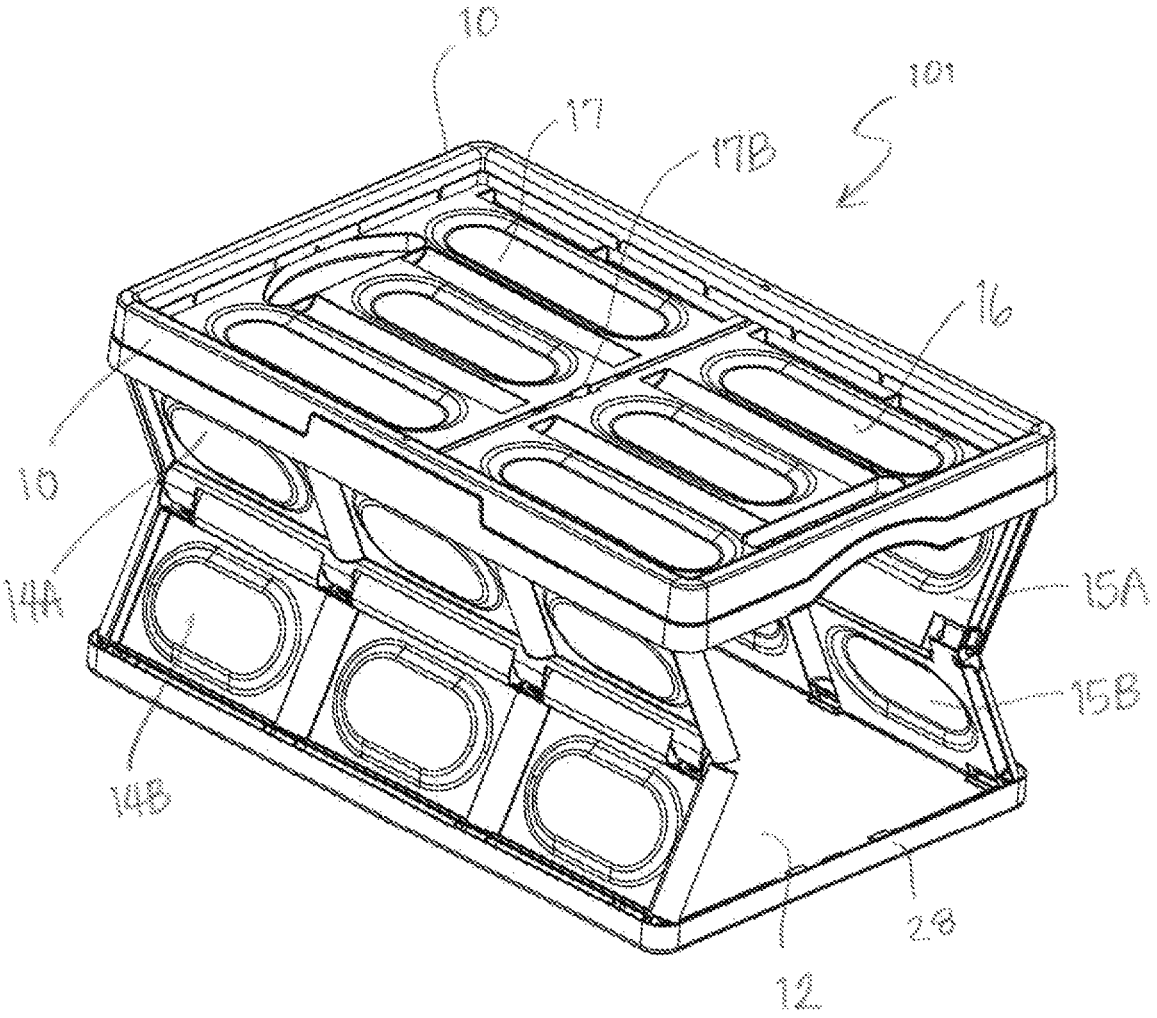
FIG. 2 is a perspective view of the crate of FIG. 1 in an intermediate configuration between erect and collapsed configurations.
Figure 3:
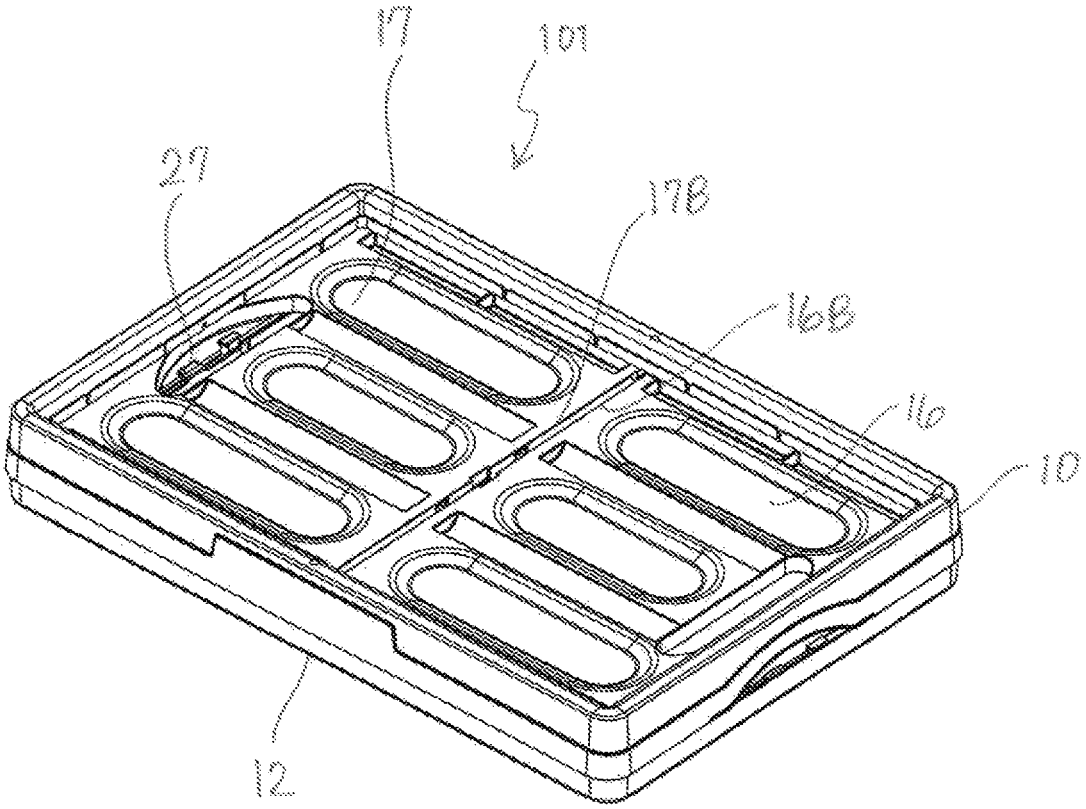
FIG. 3 is a perspective view of the crate of FIG. 1 in a collapsed configuration.

Referring now to FIG. 1, FIG. 2 and FIG. 3, a collapsible crate 100 in some embodiments includes a crate member or container 101 and a detachable lid member 102. In some embodiments, the crate member 101 includes a bottom member 12, first and second side walls 14, 15 and first and second end walls 16, 17. The bottom member 12 has first and second side edges 12A, 12C and first and second end edges 12B, 12D. Each side wall 14, 15 has a horizontal hinge HX that generally bisects each side wall into an upper portion 14A, 15A and a lower portion 14B, 15B and allows the upper and lower portions to fold onto each other. An upper peripheral rim 10 extends along upper edges of the side walls 14, 15 and the end walls 16, 17 to surround an opening 18 into an inner volume V of the crate member 101. The rim 10 includes a rim portion 10A extending along an upper edge of the first upper side wall portion 14A, a rim portion 10B extending along an upper edge of the first end wall 16, a rim portion 10C extending along an upper edge of the second upper side wall portion 15A, and a rim portion 10D extending along an upper edge of the second end wall 17. The first upper side wall portion 14A has a hinge HS1 at its upper edge along the rim portion 10A.

The first lower side wall portion 14B has a hinge HS3 at its lower edge along the side edge 12A of the bottom member 12, and the second lower side wall portion 15B has a hinge HS4 at its lower edge along the side edge 12C of the bottom member.

The first end wall 16 has a hinge HE1 at its upper edge along the rim portion 10B. The second upper side wall 15A a hinge HS2 at its upper edge along the rim portion 10C. The second end wall 17 has a hinge HE2 at its upper edge along the rim portion 10D. Lower edges of the first and second end walls 16, 17 are free to swing inwardly from their erect position.

The hinges HE1, HE2, HS1, HS2, HS3, HS4 and HX enable the crate 100 to be movable between an erect configuration, illustrated in FIG. 1, where the two side walls 14, 15 are opposing each other and the two end walls 16, 17 are opposing each other, with both side walls 14, 15 and both end walls 16, 17 standing or vertically upright, and a collapsed configuration, illustrated in FIG. 3, where folded side walls 14, 15 (with upper side wall portion 14A lying atop lower side wall portion 14B and upper side wall portion 15A lying atop lower side wall portion 15B) lying atop the bottom member 12, and the end panels 16, 17 lying atop the folded side walls 14, 15.

As shown in FIG. 2, transition between the two configurations is enabled by the hinges HE1, HE2, HS1, HS2 and HX, where each the end wall 16, 17 is first pivoted inwardly and upwardly along the upper hinge HE1, HE2, and each the side wall 14, 15 is then folded inwardly along horizontal hinges HX to lie between the end walls 16, 17 and the bottom member 12. The rim 10 may be a rectangular frame, for example, an open frame with the rim portions 10A, 10C parallel with each other, and the rim portions 10B, 10D parallel with each other, and the rim portions 10A and 10D at generally right angles to each other and the rim portions 10B and 10C at generally right angles to each other.

Figure 5:
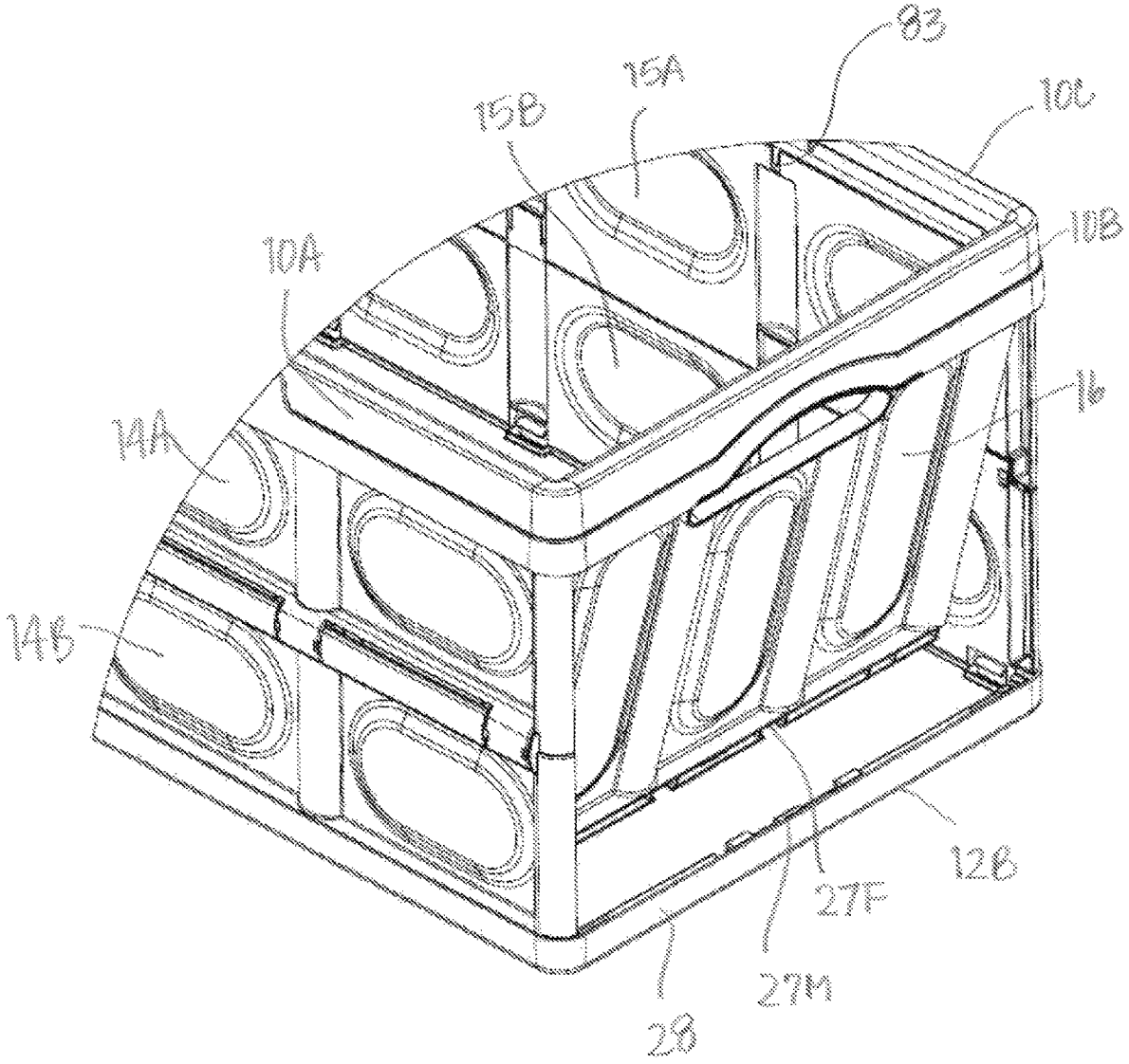
FIG. 5 is a perspective bottom top view of the crate of FIG. 1.
Figure 5A:
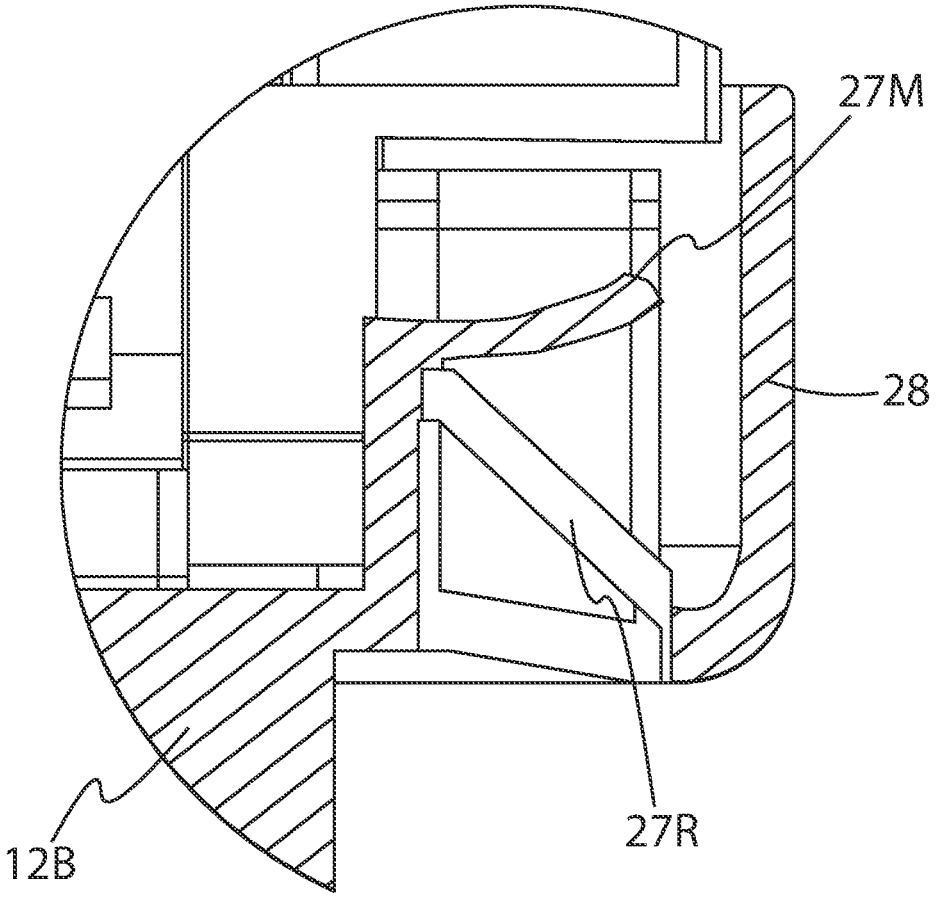
FIG. 5A is an enlarged side cross-sectional view of the circled portion A of FIG. 5.

In some embodiments, each end wall 16, 17 has a single-piece, generally planar construction and is pivotally connected at the hinge HE1, HE2, respectively, to the rim portion 10B, 10D, respectively, by interlocking projections. The interlocking projections enable the end walls 16, 17 to pivot or swing inwardly, as shown in FIG. 5. Likewise, each upper side wall portion 14A, 15A, and each lower side wall portion 14B, 15B has single-piece, generally planar construction and is pivotally connected to each other at the hinge HX by interlocking projections from a lower edge of the upper side wall portion 14A, 15A and an upper edge of the lower side wall portion 14B, 15B that allow each side wall 14, 15 to fold, as shown in FIG. 2. Each upper side wall portion 14A, 15A is also pivotally connected at the hinge HS1, HS2, respective, to the rim portion 10A, 10C, respectively, by interlocking projections. The interlocking projections enable the upper side wall portions 14A, 15A to pivot or swing inwardly about the respective axes A1, A3, as shown in FIG. 2.

To rearrange or change the crate 100 from the collapsed configuration of FIG. 3 to the erect configuration of FIG. 1, a user may hold the end rim portions 10B, 10D to lift the rim 10 off and away from the bottom member 12. As the end walls 16, 17 swing downwardly at the hinges HE1, HE2 under gravity, the user may assist by pushing the end walls outwardly with the user's thumbs. As the end walls 16, 17 swing downwardly, they push the side walls 14, 15 outwardly to unfold and assume their erect position. The user may then push the end walls 16, 17 outwardly until the lower edges of the end walls releasably lock with the end edges 12B, 12D of the bottom member 12, as described further below.

To rearrange or change the crate 100 from the erect configuration to the collapsed configuration, a user may apply a sharp inward force to the end walls 16, 17 to unlock the end walls 16, 17 from the end edges 12B, 12D of the bottom member 12. As the end walls pivot upwardly about the hinges HE1, HE2 past the horizontal hinges HX of both side walls 14, 15, the side walls 14, 15 are then free to fold at the hinges HX and collapse onto the bottom member 12. As the end walls 16, 17 swing upwardly toward the rim 10, the side walls 14, 15 can collapse fully allowing the end walls 16, 17 and the rim 10 to lie flat atop the folded side walls 14, 15.

Figure 4A:
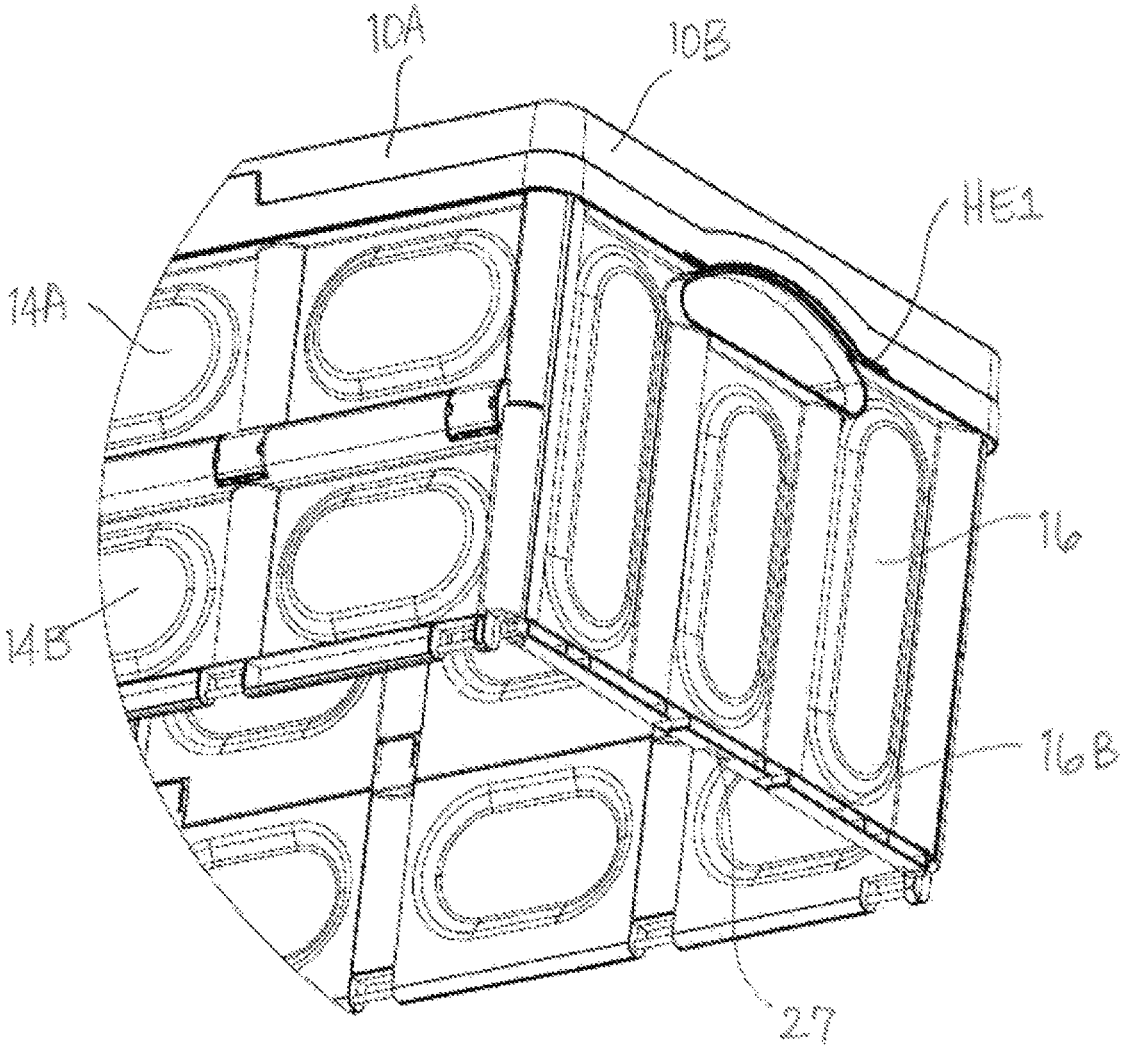
FIG. 4A is a partial perspective bottom end view of the crate of FIG. 1, with a bottom member removed for clarity.
Figure 4B:
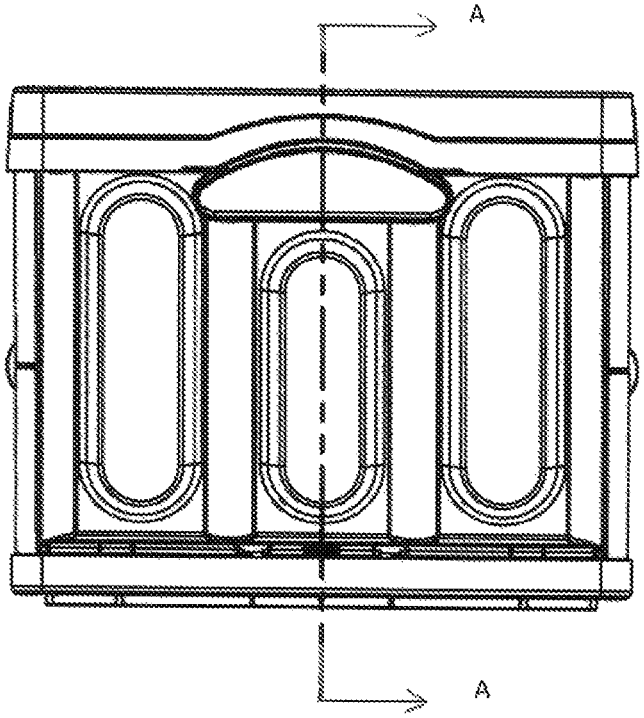
FIG. 4B is an end view of a collapsible member of FIG. 1.
Figure 4C:
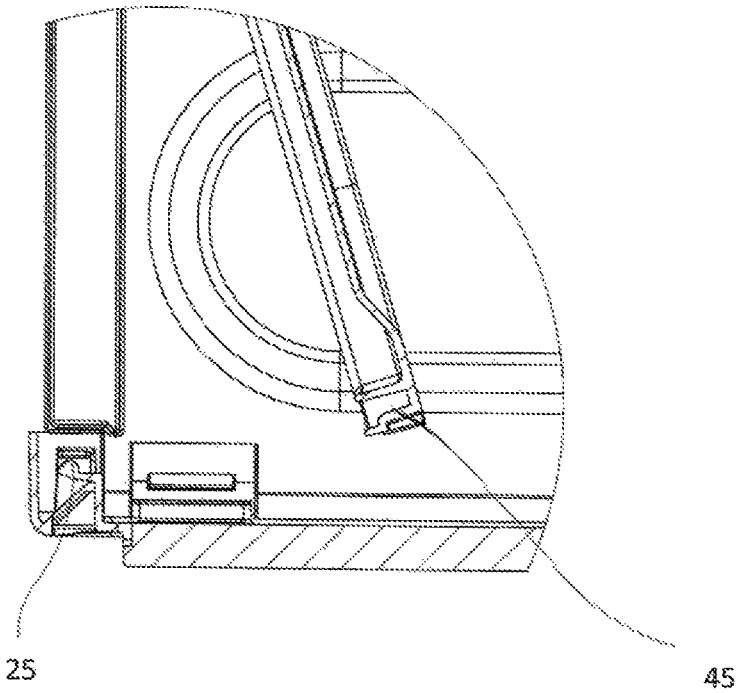
FIG. 4C is a side cross-sectional view of FIG. 4B, taken along line A-A.

In one or more embodiments, a releasable catch 27 is formed between lower end 8 of each end wall 16, 17 and each end edge 12B, 12D of the bottom member 12. In the illustrated embodiment of FIG. 4 and FIG. 5, one or more elements of the catch 27 are formed in each of the end edges 12B, 12D of the bottom member 12, each extending outwardly/upwardly as a male member or angled prong 27M that is supported by an angled ridge 27R extending along the edge 12B of the bottom member 12. For each male member 27P, there is a corresponding female member or recessed notch 27F is formed in the bottom end 16B, 17B of each end wall 16, 17, perhaps best seen in FIG. 4. In some embodiments, the male member 27M is curved so that it can be wedged within the female member 27F so a threshold inward force is necessary to release the catch 27 and allow the end walls to move from its erect position. In some embodiments, a rim 28, as shown in FIG. 5, acts as a stop to resist the end walls 16, 17 from swinging outwardly past the rim 28.

It is understood that the releasable catch 27 may be configured with each pair of the male member 27M and the female member 27F reversed such that the male member 27M is formed in the end walls 16, 17 and the female member is formed in the bottom member 12. The releasable catch 27 is configured to flex when being engaged and disengaged. When the crate 100 is rearranged from the collapsed position to the erect position, the end wall 16, 17 swings outwardly and the releasable catch members 27F, 27M engage with the rim 28 preventing the end walls 16, 17 from swinging outwardly past the vertical plane. When the crate 100 is rearranged from the erect configuration to the collapsed configuration, a user applies a threshold inward force on each end walls 16, 17 to release the catch 27 in releasing the end walls 16, 17 to swing inwardly, allowing the crate to begin to collapse.

In some embodiments, the crate 100 may include more than one releasable catches for each of end walls 16, 17. In the illustrated embodiment, the one releseasable catch is formed in a generally center location along the bottom edge 16B, 17B of each of end walls 16, 17 and the end edges 12B, 12D of the bottom member 12.

In some embodiment, one or more alignment guide tabs 25 are provided between the bottom edge of each end wall 16, 17 and the end edge 12B, 12D of the bottom member 12. In the illustrated embodiment of FIG. 4A, FIG. 4B and FIG. 4B, the end edge 12B of the bottom member 12 includes one or more projecting tabs 25 extending inwardly, and the bottom edge of the end wall 16, 17 includes one or more slot openings 45 adapted to receive the tabs 25. Each tab 25 is configured to extend into a corresponding opening 45 to guide the end wall 16, 17 as it approaches its standing position. It is understood that the arrangement of the tabs 25 and the openings 45 may be altered, for example, reversed where the tabs 25 are formed at the bottom edge of the end walls 16, 17 and the openings 45 are formed at the end edge of the bottom member 12. A suitable collapsible crate is described in U.S. patent application Ser. No. 14/746,770, titled Collapsible Crate, filed Jun. 22, 2015, the entire disclosure of which is incorporated herein by reference.

In one or more embodiments, the crate 100 is configured to accommodate one or more hanging file folders in its interior. As shown in FIG. 1, an elongated U-shaped groove 80 is formed in the inner surface of each of at least opposing upper rim portions 10A and 10C. Each groove 80 has an inner vertical wall or rail 81 that can be generally parallel with its adjacent side wall 14, 15. The rails 81 are configured to retain end hooks of a hanging file folder so that the end hooks can slide along the rails to allow the hanging file folder to move inside the crate while keeping contents of the hanging file folders generally suspended inside the crate. In some embodiment, the rim 10 includes one or more grooves 80 and rails 81 in each of the opposing upper rim portions 10B and 10D. One or more of these grooves 80 and rails 81 along rim portions 10A, 10B, 10C and 10D may be connected in different combinations, or be all connected to form on a continuous grove and rail extending along the rim 10 and its corners.

Figure 6:
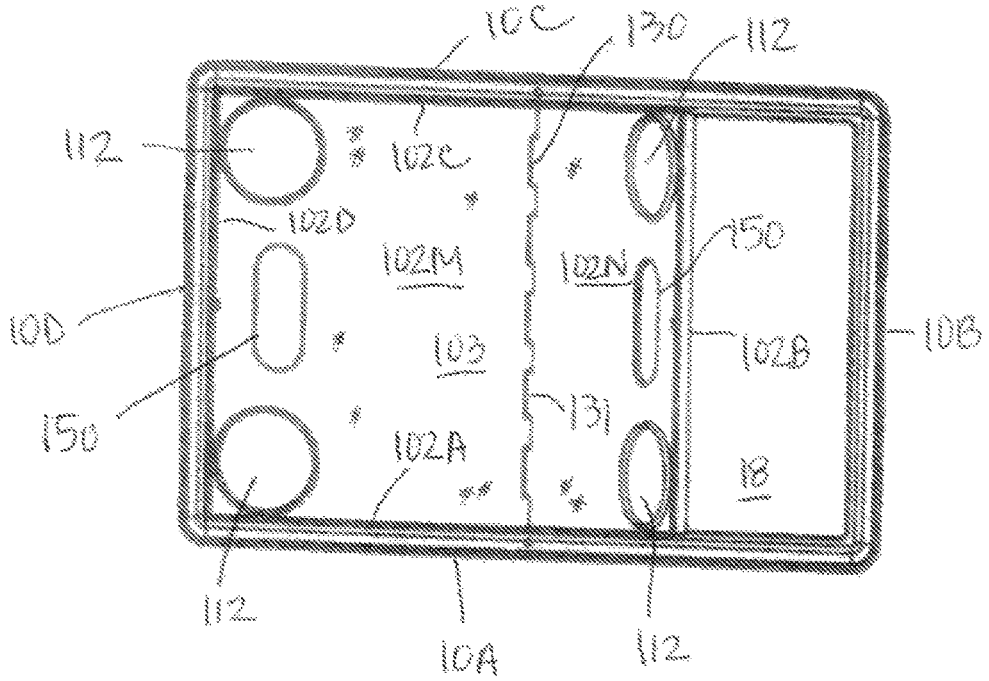
FIG. 6 is a top plan view of the crate of FIG. 1.
Figure 7:
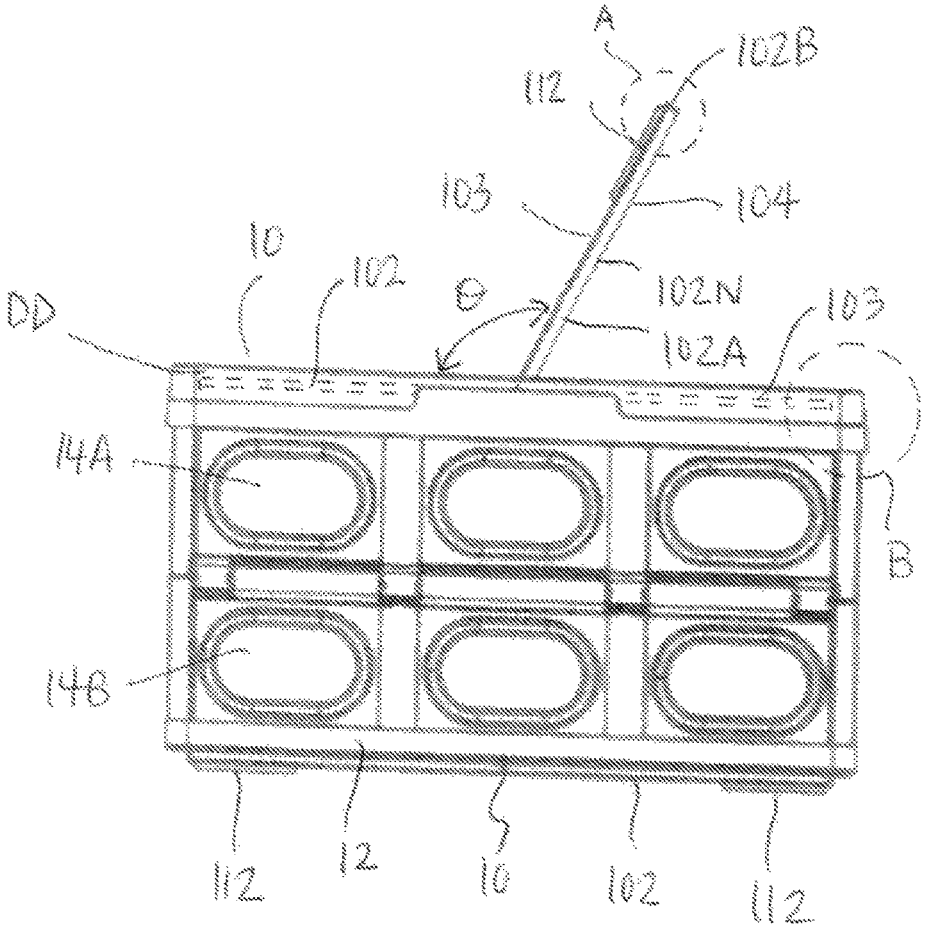
FIG. 7 is a side elevational view of the crate of FIG. 1.

In one or more embodiments, the detachable lid member 102 has a generally planar form with a rectangular configuration having opposing sides 102A, 102C and opposing ends 102B, 102D, as shown in FIG. 1, FIG. 6 and FIG. 7, and the lid member 102 is configured to sit within the upper peripheral rim 10 of the crate member 101. When positioned on the crate member 101 to cover the interior, the lid member 102 has an outer surface 103 that is configured to face away from the crate interior and an inner surface 104 that is configured to face into the crate. The lid member 102 has a downwardly peripheral flange 105 that extends in the direction of the inner surface 104 and wraps around the side 102A, 102C and ends 102B, 102D of the lid member 102, including its four corners. A height of the flange 105 defines a depth D (FIG. 1) of the lid member 102.

When the lid member 102 is deployed in covering the crate member 101, the peripheral flange 105 is configured to sit in the groove 80 extending along the upper peripheral rim 10 of the crate member 101. In that regard, the depth of the groove 80 and the height of the flange 105 are configured so that the outer surface 103 of the lid member 102 sits no higher than the highest surface of the upper peripheral rim 10 when the lid member is deployed on the crate member 101. In one or more embodiments, the outer surface 103 (shown in broken lines in FIG. 7) sits below the highest surface of the upper peripheral rim 10 so as to provide a recessed support surface on the crate member 101. The recessed support surface is adapted to receive and support a second crate or other objects placed on the lid member, where the peripheral rim 10 can facilitate stackability by helping stabilize such second crate or other objects from shifting about on the crate member 101. The lid member 102 is configured to cover the entirety of the opening 18 into the interior of the crate member 101 except for one or more access openings 150 formed in the lid member 102, as described in detail further below.

To structurally reinforce the lid member 102 especially around its periphery, the lid member is configured with guiding rib members 120. In one or more embodiments, the inner surface 104 is formed with the guiding rib members 120. Multiple linear elongated rib members 120 extend inwardly from the flange 105 on the sides 102A, 102C and/or inwardly from the flange 105 on the ends 102B, 102D. The rail 81 of the groove 80 of the crate member 101 is formed with a plurality of slots 83 (FIG. 1), each corresponding and configured to receive a respective rib member 120 so that the rib members and the corresponding slots help align and guide proper placement of the lid member 102 onto the peripheral rim 10. The slots 83 also allow the flange 105 of the lid member 102 to sit in the groove 80 of the peripheral rim 10 without the rail 81 obstructing the rib members when the lid member 102 is covering the crate member 101. With this configuration, the lid member 102 sits no higher than the upper surface of the peripheral rim 10 of the crate member 101, as shown in FIG. 7. In the disclosed embodiment, the lid member 102 sits a predetermined distance DD, as shown in FIG. 7, slightly below the upper surface of the peripheral rim 10 of the crate member 101. The predetermined DD is understood to be dependent on factors, including, for example, the height of the rail 81 of the rim 10, the depth of the flange 105 of the lid member 102, and other predetermined configuration, placement and dimensions of the rim 10 and the lid member 102.

Figure 8:
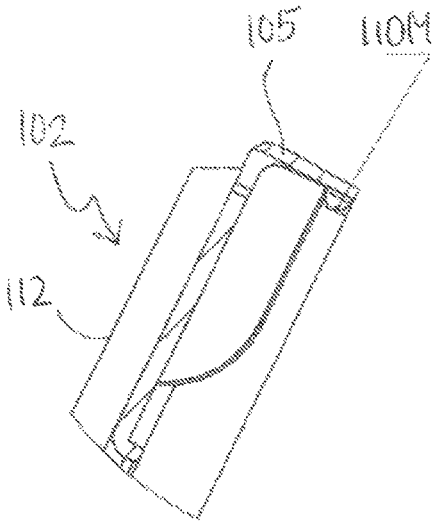
FIG. 8 is an enlarged side cross-sectional view of the circled portion A of FIG. 7.
Figure 9:
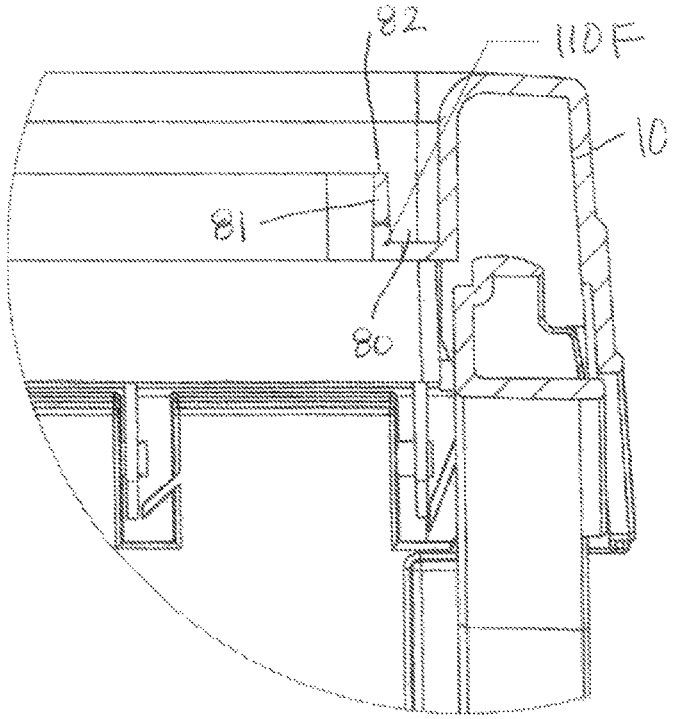
FIG. 9 is an enlarged side cross-sectional view of the circled portion B of FIG. 7.
Figure 8A:
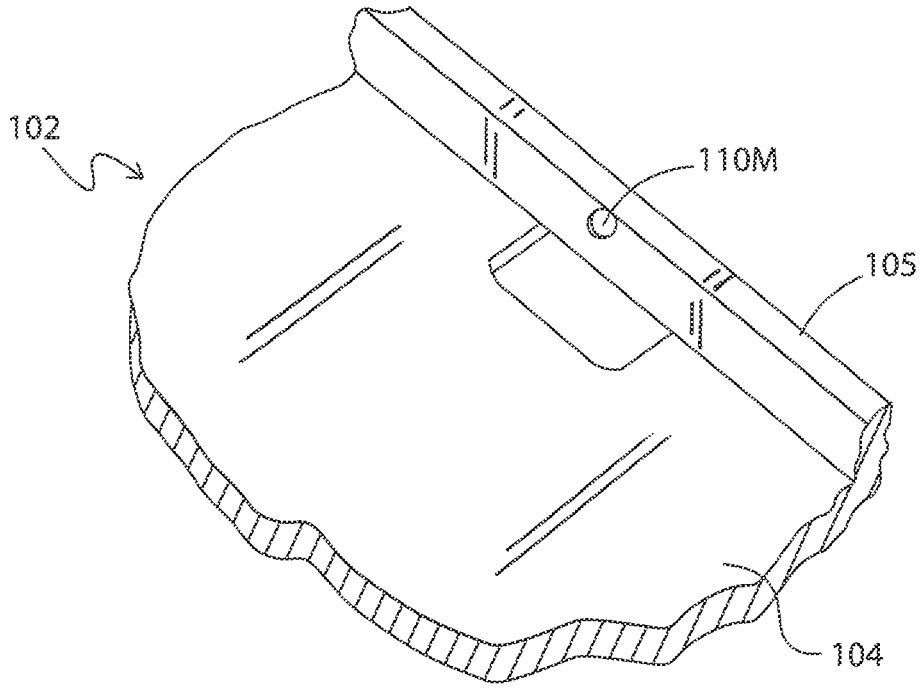
FIG. 8A is a detailed, partial perspective view of an inner surface of an end portion of a lid member, with a male latch member, according to one or more embodiments.
Figure 9A:
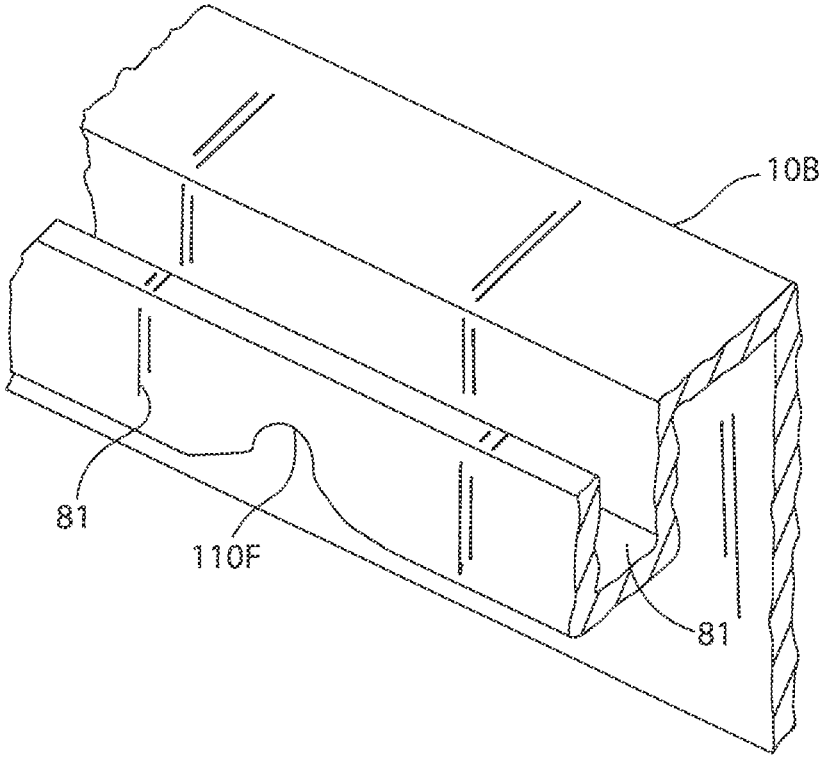
FIG. 9A is a detailed, partial perspective view of a rim portion of a crate member, with a female latch member, according to one or more embodiments.

When covering the crate member 101, the lid member 102 can be releasably latched to the top of the crate member 101 by a releasable latch 110 formed in the crate member 101 and the lid member 102. In one or more embodiments, a releasable latch 110 includes a male member or raised nub 110M formed on an inner surface 104 of the peripheral flange 105 of the lid member 102, as shown in FIG. 8 and FIG. 8A, and a female member or cutout 110F formed in the rail 81 of the groove 80 of the rim 10 of the crate member 101 in FIG. 9 and FIG. 9A. In the illustrated embodiment, the male member 110M is formed at a midpoint of each end 102B, 102D of the lid member 102, and the female member 110F is formed at a midpoint of each rail 81 along the rim portions 10B and 10D.

Each male member 110M is configured to releasably engage a corresponding female member 110F when the lid member 102 is deployed and positioned on the crate member 101. To engage the latch 110, a user pushes down with sufficient threshold force on the lid member 102 in the area where the latch elements are located so that the male member 110M rides over an upper edge 82 of the rail 81 and snaps into or with the female member 110F. To release the latch 110, a user can lift the lid member 102 by inserting one or more fingers into an adjacent access opening 150 and pulling up the lid member with sufficient force to release the male member 110M from the female member 110F. In the illustrated embodiment, the crate 100 includes two latches 110, one near each end wall 14, 15, with each latch 110 having an adjacent access opening 150. In other embodiments, it is understood that each latch 110 may be configured in the reverse with the male member 110M formed in the rim 10 and the female member 110F formed in the lid member 102.

In one or more embodiments, the lid member 102 includes at least one hinge 130 that enables the lid member to be folded, if not, also separated and detached into multiple separate lid portions, as shown in FIG. 1, FIG. 6 and FIG. 7. In the illustrated embodiment, the hinge 130 extends between the opposing sides 102A, 102C and bisects the lid member into two generally-equal lid portions 102M and 102N along a seam 108 defined by adjacent edge 109 of the portion 102M and edge 117 of the portion 102N. The hinge 130 opens and closes bidirectionally so that the lid member 102 can be folded with either outer surfaces 103A, 103B approaching each other or inner surfaces 104A, 104B approaching each other. When the lid member 102 is closed or latched to the crate member 101, the hinge 130 conveniently allows a user to lift one of lid portions 102M, 102N about the hinge to access the interior of the crate member 101 without lifting or removing the lid member in its entirety.

As shown in FIG. 11A, FIG. 11B, FIG. 11C and FIG. 11D, the hinge 130 includes alternating male knuckles 131M and female knuckles 131F that releasably interlock with each other. In some embodiments, the knuckles are co-planar extensions of their respective lid portions, where the male knuckles 131M are formed along the edge 109 of the lid portion 102M and the female knuckles 131F are formed along the edge 117 of the lid portion 102N. The male and female knuckles 131M and 131F can be pulled apart and snap back together with ease.

Figure 12A:
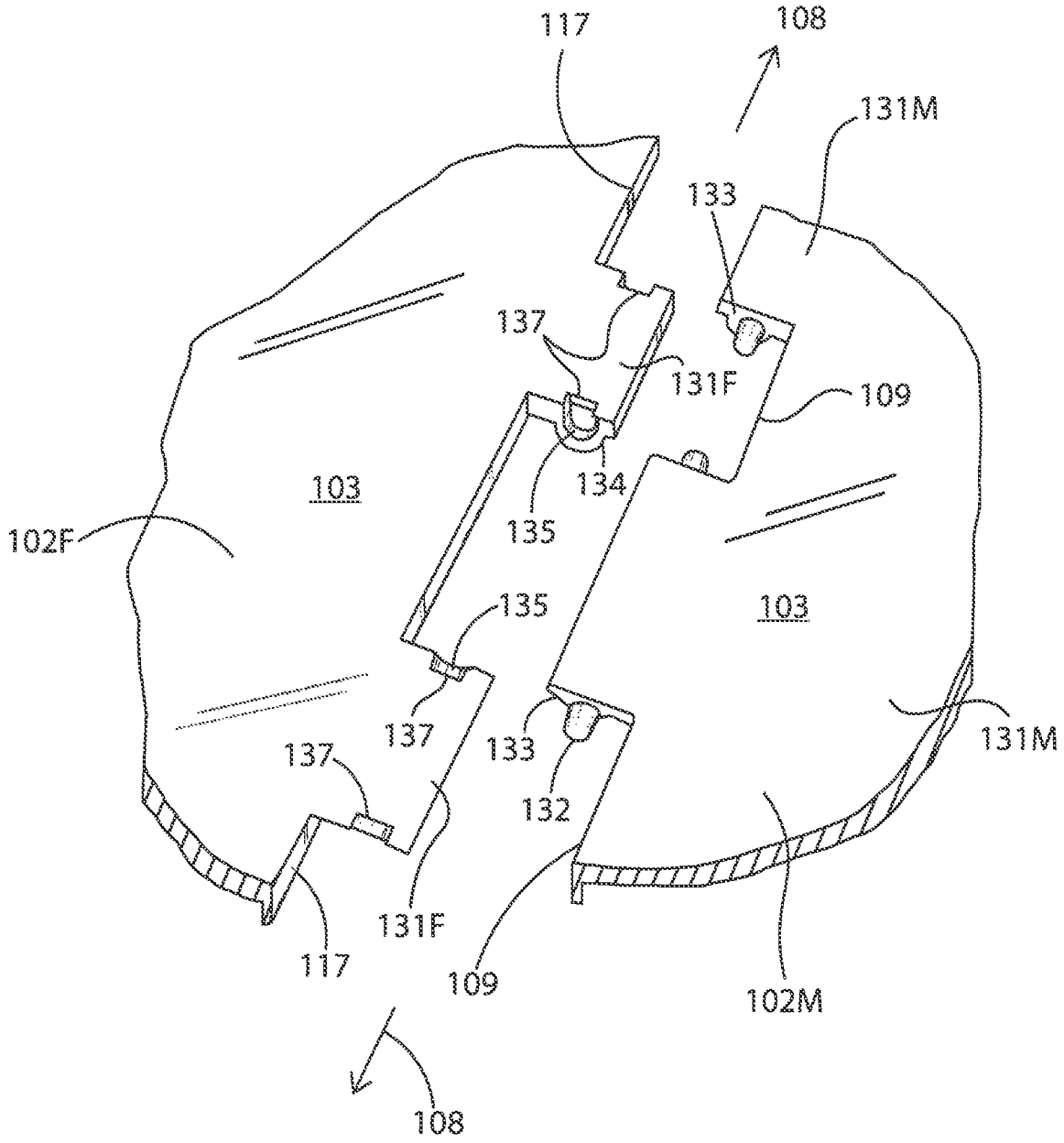
FIG. 12A is partial perspective view of an outside surface a lid member, according to an embodiment, with male and female knuckles of a hinge detached from each other.
Figure 12B:
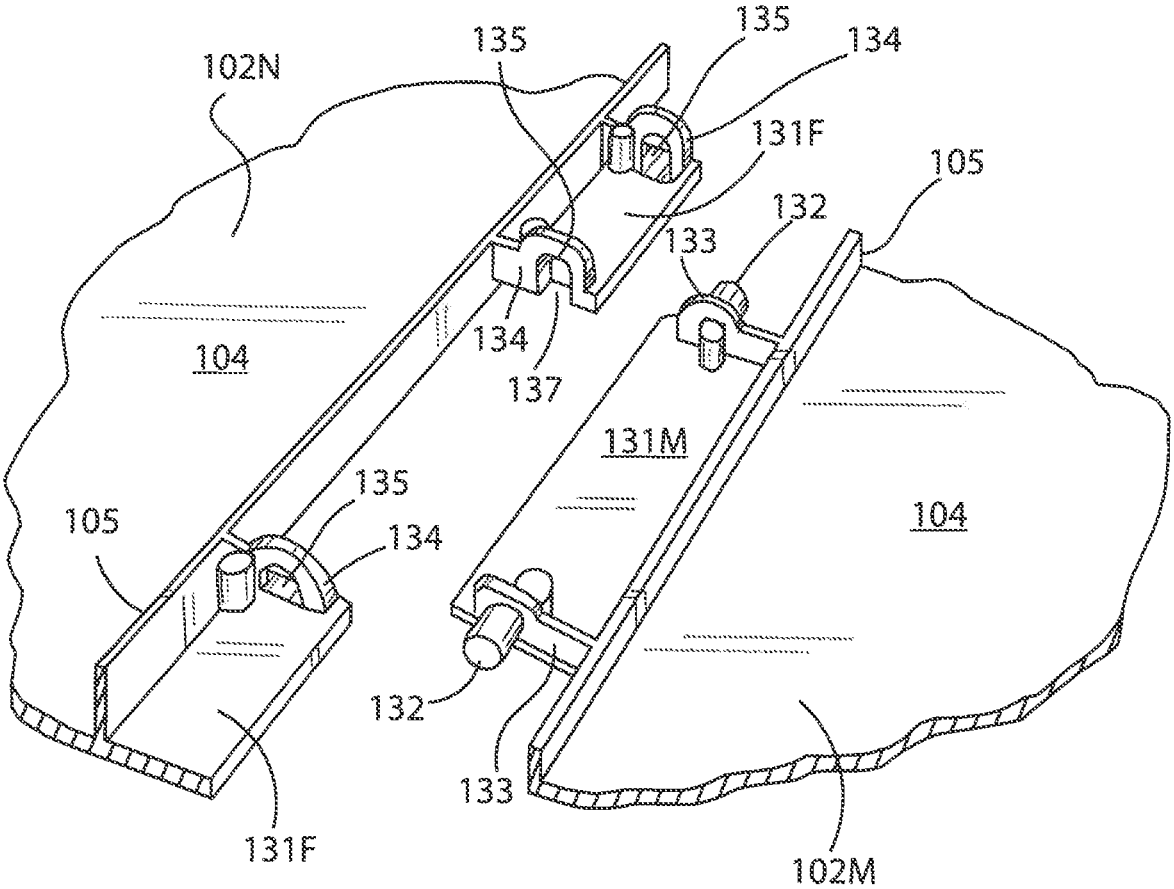
FIG. 12B is a partial perspective view of an inside surface of a lid member, according to an embodiment, with male and female knuckles of a hinge detached from each other.

As shown in FIG. 12A and FIG. 12B, each male knuckle 131M has depending end pieces 133 that extend perpendicularly from the inner surface of knuckle, and two opposing pins 132 that extend from each end piece 133 in a direction parallel to the seam 108. Each female knuckle 131F has similar depending end pieces 134 that are formed with apertures 135 which are configured to receive a respective pins 132 of two adjacent male knuckles 131M. When coupled, the male and female knuckles 131M and 131F form the hinge 130 in alternating positions along the seam 108. In the illustrated embodiment, the hinge includes six female knuckles 131F and five male knuckles, with each of the two end female knuckles having only one end piece 134 with hole 135.

Notably each female knuckle 131F has a notch opening 137 on the outer surface of the knuckle that lead into the aperture 135 of the end piece 134 which advantageously guides the pins 132 of the male knuckles 131M into their respective hole 135 when the lid portions 102M and 102N are joined to each other. In particular, a user can place the lid portions 102M and 102N next to each other with their inner surfaces facing a sturdy supporting surface. The edges 109 and 117 should be generally aligned with the pins 132 of the male knuckles 131M resting above respective notch openings 137 of the female knuckles. The user can then push down on the male knuckles 131M to snap each pin 132 into its respective hole 135 of the female knuckles 131F. Once the pins 132 are snapped into the holes 135, the male and female knuckles are interlocked to form the hinge 130 that allows the lid portions 102M and 102N to form a singular plane or be folded directionally along the hinge. In that regard, the length of each pin 132 is predetermined to enable the pin to both extend through and protrude past the aperture 135 so that the pin remains engaged in the aperture until intentionally disengaged by the user.

To separate and detach the lid portions 102M and 102N from each other in some embodiments, the user can hold the lid member with the hinge 130 oriented vertically, with one lid portion in one hand and the other lid portion in the other hand, and shift one lid portion upwardly and the other lid portion downwardly. In that regard, the male and female knuckles are sized so to provide a small predetermined space gap between adjacent knuckles which allows a degree of relative lateral movement between the two lid portions. By shifting one lid portion upwardly and the other lid portion downwardly, the user can dislodging the pins 132 from the apertures 135 and disengaging the male and female knuckles 131M and 131F, one by one starting at one end of the hinge 130 and working toward the other end of the hinge, much like unzipping a zipper with relative ease.

As shown in FIG. 1 and FIG. 7, the hinge 130 of the lid member 102 allows the lid member 102 when closed on the crate member 101 to be movable between a fully-closed position with the first and second lid portions 102M, 102N generally defining a common plane and a partially-closed position with the first and second lid portions defining an angle θ between them at the hinge 130.

In one or more embodiments, the outer surface 103 of the lid member 102 is formed with one or more cupholder formations 112 defined by one or more circular raised ridges. In the illustrated embodiment of FIG. 6, the outer surface 103 has cupholder formations 112 in each corner region of the lid member 102. The outer surface 103 may also be textured differently between the regions inside and outside of the cupholder formations 112. In the illustrated embodiment, the outer surface 103 outside the cupholder formations 112 may be texturized with a more friction-inducing surface than the outer surface 103 inside the cupholder formations 112.

Figure 10A:
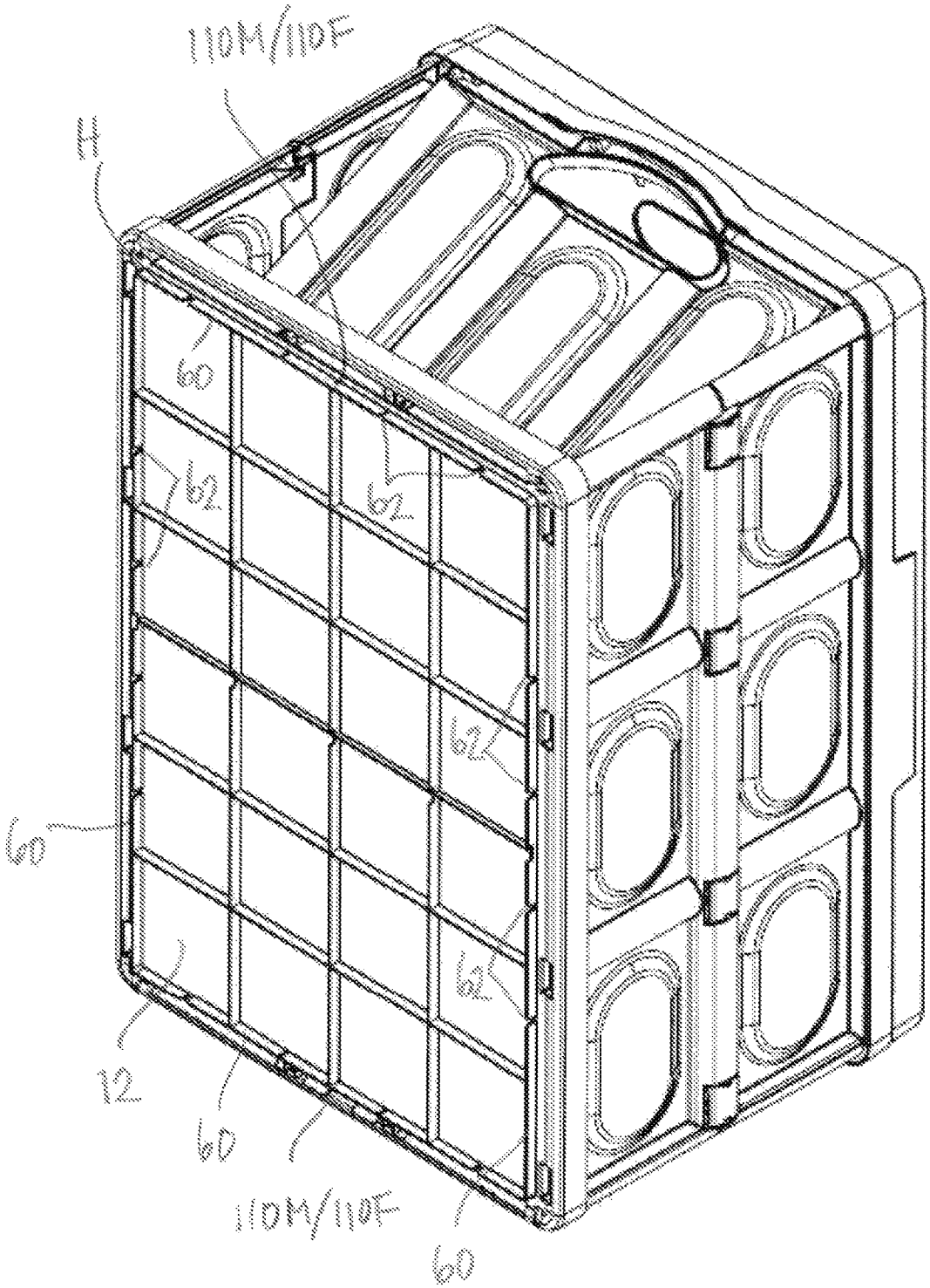
FIG. 10A is a bottom perspective view of the crate of FIG. 1, without a lid member stowed on a bottom member.
Figure 10B:
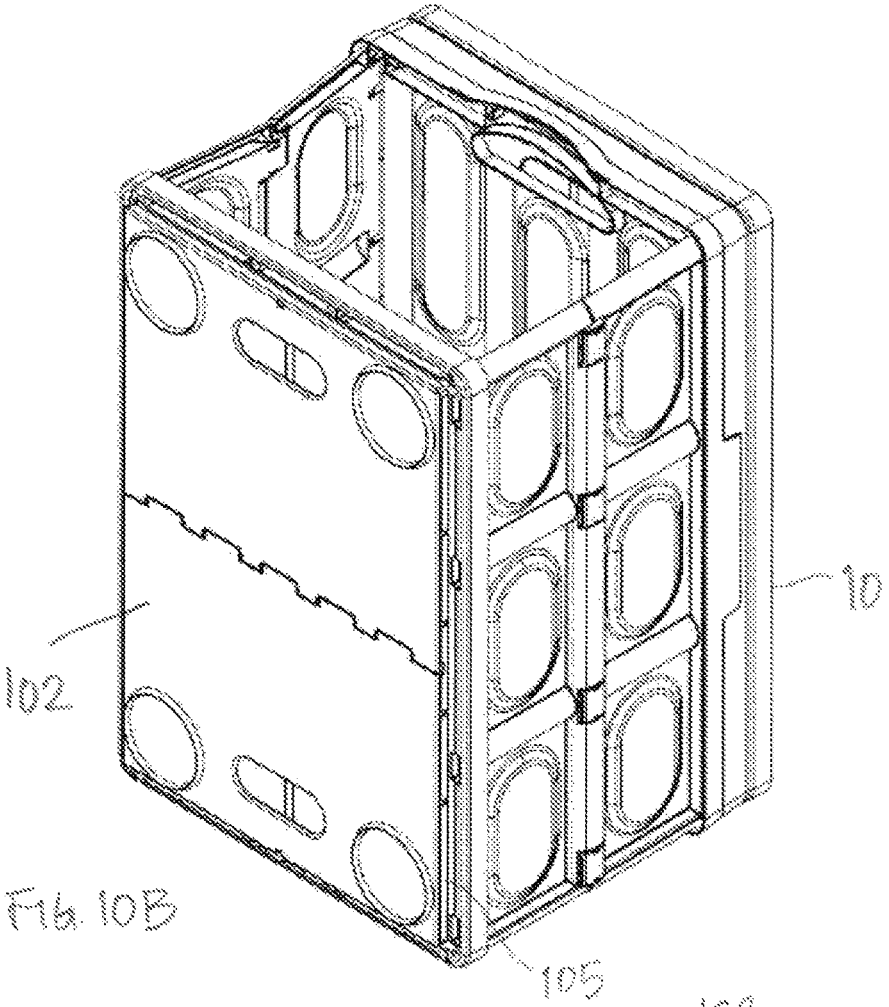
FIG. 10B is a bottom perspective view of the crate of FIG. 1, with a lid member stowed on a bottom member.
Figure 10C:
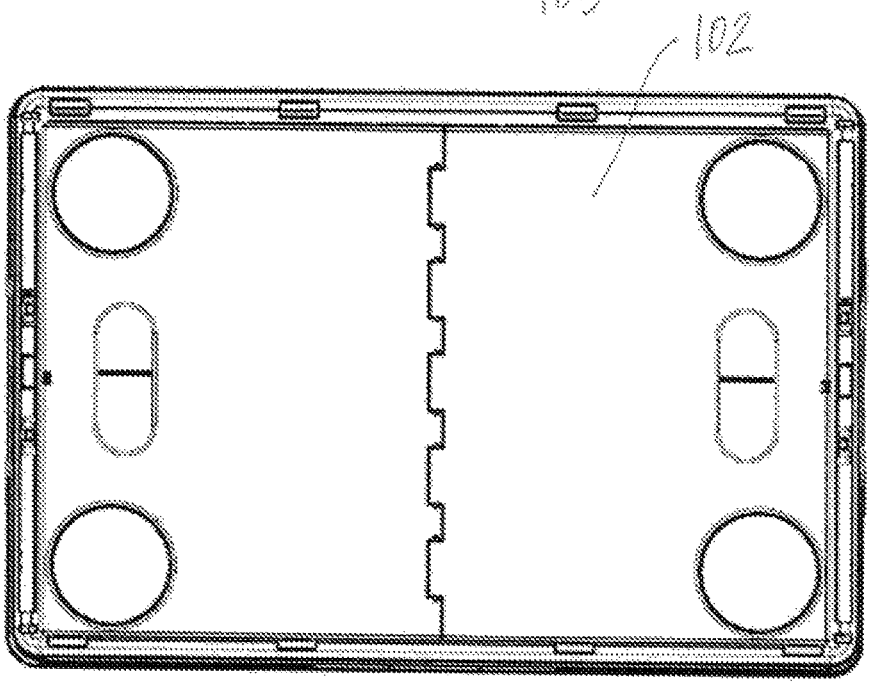
FIG. 10C is a bottom plan view of FIG. 10B.
Figure 11C:
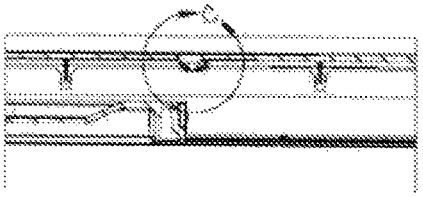
FIG. 11C is a side cross-sectional view of FIG. 11B, taken along line B-B.
Figure 11D:
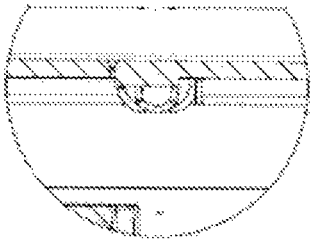
FIG. 11D is a detailed view of the circle portion C of FIG. 11C.
Figure 11A:
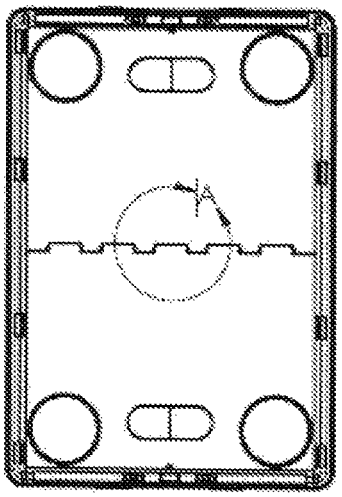
FIG. 11A is a top plan view of a lid, according to one or more embodiments.
Figure 11B:
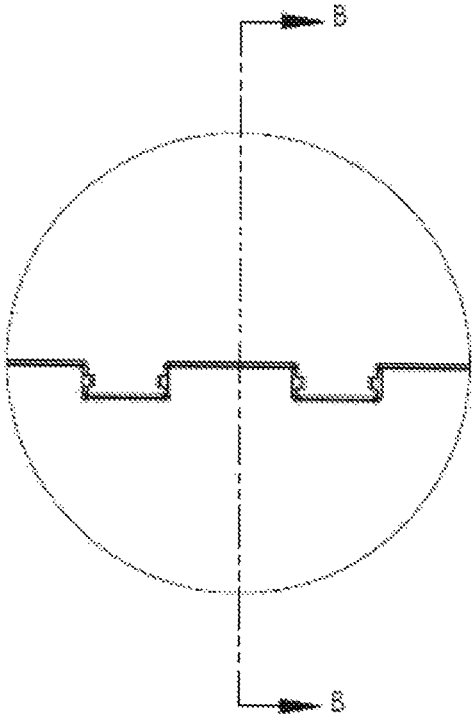
FIG. 11B is a detailed view of the circle portion A of FIG. 11A.

As shown in FIG. 10A, FIG. 10B and FIG. 10C, an outer surface of the bottom member 12 includes a bottom rail 60 that extends around a peripheral region 62 of the bottom member 12. The bottom rail 60 is configured comparably to the lid member 102 in terms of size and shape so that the lid member 102 can be detachably mounted onto the bottom rail 60 for stowage when the lid member 102 is not in use covering the crate member 101. The bottom rail 60 has height H that is generally equal to or greater than the depth D of the lid member 102. The bottom rail 60 has slots 62, each of which corresponds and is configured to receive with a respective rib member 120 of the lid member 102 when the lid member 102 is mounted onto the bottom rail 60 for stowage under the crate member 101.

The bottom rail 60 includes one or more latch members 110M or 110F, as appropriate, as part of the releasable latch 110 to releasably engage with the counterpart latch member 110F or 110M formed in the lid member 102 so that the lid member 102 can be releasably attached to the bottom rail 60. As such, the crate member 101 can be carried around with the lid member 102 attached to the bottom member 12 (see FIG. 10A). To stow the lid member 102, a user may place the lid member 102 on a support surface with the inner surface 104 facing upwardly. The user then may position the crate member 101 above the lid member 102 with the bottom rail 60 of the crate member 101 generally aligned with the peripheral flange 105 of the lid member 102, and push downwardly on the crate member 101 until the one or more latches 110M/110 of the lid 102 (FIG. 8A) and the bottom rail 60 (FIG. 10A) engage. The lid member 102 can thus be attached to the bottom of the crate member 101 when the latter is carried about by a user. To release the lid member 102 from the bottom rail 60, the user pulls the lid member 102 away from the bottom rail 60 by inserting one or more fingers into one or more access openings 150 with sufficient force to release the one or more latches.

It will be understood by persons skilled in the art that any of the features described herein may be used alone or in combination and in addition to or in lieu of any other features described herein, as desired or appropriate, and still remain within the spirit and scope of the present disclosure.

While this disclosure has been described in detail with particular references to some exemplary embodiments thereof, the exemplary embodiments described herein are not intended to be exhaustive or to limit the scope of the disclosure to the exact forms disclosed. It is understood that the drawings are not necessarily to scale. Persons skilled in the art and technology to which this disclosure pertains will appreciate that alterations and changes in the described structures and methods of assembly and operation can be practiced without meaningfully departing from the principles, spirit, and scope of this disclosure, as set forth in the following claims and their equivalents.

What is claimed is:

1. A collapsible crate movable between an erect configuration and a collapsed configuration, comprising:

a crate member having an upper peripheral rim, a bottom member, two hinged and collapsible opposing side walls and two hinged end walls that collectively define an interior volume when the crate member is in the erect configuration;

a lid member with first and second lid portions and a hinge between the first and second lid portions, the lid member having a flange, and the bottom member having a bottom rail, wherein the bottom rail is configured to sit inside of the flange when the lid member is stowed under the bottom member.

2. The collapsible crate of claim 1, further comprising a releasable latch configured to releasably latch the lid member to the crate member, the releasable latch having a male member and a female member, wherein the male member is formed in one of the group consisting of the lid member and the peripheral rim and the female member formed in the other of the group consisting of the lid member and the peripheral rim.

3. The collapsible crate of claim 1, wherein the lid member has a flange, and the upper peripheral rim has a groove and a rail, wherein the flange is configured to fit in the groove when the lid member is positioned to cover the crate member in the erect configuration.

4. The collapsible crate of claim 1, further comprising a releasable latch configured to releasably latch the lid member to the bottom member, the releasable latch having a male member and a female member, wherein the male member is formed in one of the group consisting of the lid member and the bottom rail and the female member formed in the other of the group consisting of the lid member and the bottom rail.

5. The collapsible crate of claim 1, wherein the lid member has a rib member and the bottom rail has a corresponding slot configured to receive the rib member when the lid member is stowed under the bottom member.

6. The collapsible crate of claim 1, wherein at least one of the first and second lid portions includes an access opening.

7. The collapsible crate of claim 1, wherein the hinge of the lid member is configured such that the lid member is movable between a fully-closed position with the first and second lid portions generally defining a common plane and a partially-closed position with the first and second lid portions defining an angle between them at the hinge.

8. The collapsible crate of claim 1, wherein the hinge of the lid member is configured to releasably couple the first and second lid portions.

9. The crate of claim 1, wherein the hinge between the first and second lid portions includes a male knuckle and a female knuckle, the male knuckle having a pin and the female knuckle having an aperture configured to receive the pin.

10. The crate of claim 1, wherein the female knuckle also includes a notch that leads into the aperture configured to ease entry and exit of the pin into the aperture.

11. The crate of claim 1, wherein the male and female knuckles are sized to provide a predetermined space gap between their adjacent ends.

12. The crate of claim 1, wherein the hinge is configured to provide bi-directional folding of the first and second lid portions along the hinge.

13. A collapsible crate movable between an erect configuration and a collapsed configuration, comprising:

a crate member having an upper peripheral rim, a bottom member, two hinged and collapsible opposing side walls and two hinged end walls that collectively define an interior volume when the crate member is in the erect configuration, the upper peripheral rim having a groove and a rail; and a lid member with first and second lid portions and a hinge between the first and second lid portions, the lid member having a flange, the flange configured to fit in the groove when the lid member is positioned to cover the crate member in the erect configuration, the lid member having a rib member, and the rail of the peripheral rim having a corresponding slot configured to receive the rib member when the lid member is positioned to cover the crate member in the erect configuration.

14. A collapsible crate movable between an erect configuration and a collapsed configuration, comprising:

a crate member having an upper peripheral rim, two hinged and collapsible opposing side walls, two hinged end walls and a bottom member that collectively define an interior volume when the crate member is in the erect configuration; and a lid member with first and second lid portions and a hinge between the first and second lid portions, wherein the lid member and the crate member include latch members configured to releasably latch the lid member to the crate member in a use position and in a stowed position, wherein the latch members include a male member and a female member, and wherein the crate member has an upper latch member formed in the rim and a lower latch member formed in the bottom member, wherein the upper latch member is configured to releasably latch the lid member in a use position and the lower latch member is configured to releasably latch the lid member in a stowed position.

15. The collapsible crate of claim 14, wherein the male member includes a nub and the female member includes an opening.

16. The collapsible crate of claim 14, wherein the upper peripheral rim includes a groove and the lid member includes a flange configured to sit in the groove when the lid member is positioned to cover the crate member.

17. The crate of claim 14, wherein the lid member is configured to sit no higher than an upper surfaced of the rim of the crate member.

18. The crate of claim 14, wherein the lid member has an access opening.

19. The crate of claim 16, wherein the upper peripheral rim includes a rail, and the rail and the rim are configured to suspend a hanging file folder for use with the crate.

20. A collapsible crate movable between an erect configuration and a collapsed configuration, comprising:

a crate member having an upper peripheral rim, two hinged and collapsible opposing side walls, two hinged end walls and a bottom member that collectively define an interior volume when the crate member is in the erect configuration; and a lid member with first and second lid portions and a hinge between the first and second lid portions, wherein the lid member and the crate member include latch members configured to releasably latch the lid member to the crate member in a use position and a stowed position, the lid member having a rib member and the rim having a rail with a slot receives the rib member when the lid member is positioned on the crate member in the stowed position.

21. The crate of claim 20, wherein the lid member has a flange and a rib member extends from the flange.

* * * * *